US010758800B2

(12) United States Patent
Lawhon

(10) Patent No.: US 10,758,800 B2
(45) Date of Patent: Sep. 1, 2020

(54) BASEBALL AND SOFTBALL TRAINING DEVICE AND METHOD

(71) Applicant: Harold Lawhon, Orange, CA (US)

(72) Inventor: Harold Lawhon, Orange, CA (US)

( * ) Notice: Subject to any disclaimer, the term of this patent is extended or adjusted under 35 U.S.C. 154(b) by 0 days.

(21) Appl. No.: 16/184,777

(22) Filed: Nov. 8, 2018

(65) Prior Publication Data

US 2020/0147467 A1 May 14, 2020

(51) Int. Cl.

| | |
|---|---|
| ***A63B 69/00*** | (2006.01) |
| ***A63B 63/00*** | (2006.01) |
| ***A63B 71/02*** | (2006.01) |
| *A63B 102/18* | (2015.01) |

(52) U.S. Cl.

CPC ..... *A63B 69/0002* (2013.01); *A63B 63/00* (2013.01); *A63B 71/023* (2013.01); *A63B 2069/0004* (2013.01); *A63B 2071/026* (2013.01); *A63B 2102/18* (2015.10); *A63B 2102/182* (2015.10); *A63B 2210/50* (2013.01); *A63B 2225/093* (2013.01)

(58) Field of Classification Search

CPC ..... A63B 69/0079; A63B 63/00; A63B 59/00; A63B 69/0097; A63B 67/002; A63B 61/02; A63B 69/0002; A63B 71/023; A63B 2102/18; A63B 2069/0004; A63B 2071/026; A63B 2210/50; A63B 2225/093

USPC ..... 473/197, 428–430, 446, 473, 474, 476, 473/497, 456, 565; 273/400, 398, 410, 273/407; D21/700–705, 788–790

See application file for complete search history.

(56) References Cited

U.S. PATENT DOCUMENTS

| | | | | | |
|---|---|---|---|---|---|
| 906,392 | A | * | 12/1908 | Dietz | F41G 3/26 434/11 |
| 1,224,387 | A | * | 5/1917 | Lane | E02D 5/80 473/492 |
| 1,419,554 | A | * | 6/1922 | Ganse | A63B 67/002 473/478 |
| 2,580,799 | A | * | 1/1952 | Lauterbach | A63B 63/00 473/476 |
| 3,752,476 | A | * | 8/1973 | Mahoney | A63B 69/0097 473/435 |
| D237,808 | S | * | 11/1975 | Ekstrand | D21/705 |
| 4,145,048 | A | * | 3/1979 | Basil | A63B 59/00 473/565 |
| 4,210,326 | A | | 7/1980 | Booth et al. | |
| 4,619,456 | A | * | 10/1986 | Meggs | A63B 63/004 473/471 |
| 4,629,188 | A | | 12/1986 | Mahieu | |

(Continued)

*Primary Examiner* — Mitra Aryanpour

(74) *Attorney, Agent, or Firm* — Klein, O'Neill & Singh, LLP

(57) ABSTRACT

A sports training device is configured to be supported by one of the below-grade base anchors typically available at baseball and softball fields. The device comprises a frame made up of a net holding portion and a support portion configured to support the net holding portion. The support portion includes an insert post configured to fit into the base anchor. The net holding portion is configured to be rotatable relative to the support portion about a vertical axis. The net holding portion can also be configured to be moved—and secured in a position—transverse to the vertical axis. The training device can thus be placed in several configurations in order to provide a net target in a desired position so that a player can practice delivering a ball to the net.

16 Claims, 8 Drawing Sheets

(56) References Cited

U.S. PATENT DOCUMENTS 4,826,164 A * 5/1989 Butcher ..... A63B 63/00 473/456
4,863,166 A 9/1989 Becera et al.
4,930,774 A 6/1990 Butcher
5,039,100 A * 8/1991 Cortese ..... A63B 61/02 473/492
5,056,781 A * 10/1991 Preston ..... A63B 69/0079 473/423
5,056,795 A * 10/1991 Buhrow ..... A63B 63/08 473/594
D333,856 S * 3/1993 Cantey ..... D21/705
5,333,856 A 8/1994 Gery
5,395,122 A * 3/1995 Kraemer ..... A63B 63/00 473/195
5,611,539 A * 3/1997 Watterson ..... A63B 61/02 473/446
5,769,745 A * 6/1998 Bartoli ..... A63B 69/0013 473/497
5,803,841 A 9/1998 Daskoski
5,820,497 A * 10/1998 Pena ..... A63B 63/004 473/471
5,957,789 A * 9/1999 Ainscough ..... A63B 69/0079 473/423
6,093,120 A 7/2000 Luke, Jr.
6,800,043 B1 * 10/2004 Pohrer ..... A63B 61/02 473/422
6,834,858 B1 * 12/2004 Reineke ..... A63B 63/00 273/400
7,297,079 B1 * 11/2007 Delauter ..... A63B 61/02 473/473
7,399,243 B2 * 7/2008 Schank ..... A63B 61/02 473/492
D828,470 S * 9/2018 Lawhon, Jr. ..... D21/705
2002/0132685 A1 9/2002 Fusco
2017/0189774 A1 7/2017 Ferrari et al.

* cited by examiner

BASEBALL AND SOFTBALL TRAINING DEVICE AND METHOD

BACKGROUND

The present disclosure relates to the field of sports training devices employing nets.

Sports training devices often include nets that provide a target and ball-holder for an athlete to direct several balls while practicing from a location on a practice field. While net-holding devices are available in various configurations, most such devices cannot be easily adjusted for a particular practice configuration. Further, many portable net-holding devices are susceptible to tipping and/or translational movement due to repeated ball contact with the device.

SUMMARY

There is a need in the art for a sports training device employing a net in which the configuration of the device, and position of the net, can be adjusted. There is also a need in the art for such a device that can resist tipping and/or translational movement during use. Further, many baseball and softball fields have below-grade base anchors. There is a further need in the art for a sport training device that can take advantage of such below-grade base anchors to provide secure mounting of a device while still enabling the device to be lightweight and portable.

In accordance with one embodiment, the present disclosure provides sports training device, comprising a frame comprising a support portion and a net holding portion. The net holding portion is attachable to and supported by the support portion and is configured to hold a net so that the net has a front side and a back side. The support portion comprises an insert post configured to engage a below-grade base anchor of a ball field so that the frame is supported by the below-grade base anchor. A position of the net holding portion is adjustable relative to the support portion so that the front of the net can be put in a desired position while the insert post remains engaged with the below-grade base anchor.

Some such embodiments additionally comprise an extender configured to be releasably attachable to the net holding portion so as to extend backwardly from the net holding portion and configured to hold a portion of the net spaced from a front side of the net.

In additional embodiments, the net holding portion is rotatable relative to the support portion about a vertical axis, and a securement device is configured to lock the net holding portion in a rotatable position relative to the support portion.

In further embodiments, the net holding portion is configured to be movable relative to the support portion in a direction transverse to the vertical axis, and a securement device is configured to lock the net holding portion to the support portion with the net holding portion offset relative to the vertical axis.

In still further embodiments, the support portion comprises an elongated vertical member that is releasably attached to an insert pin of the insert post.

In some such embodiments, the vertical member has a member pin, and each of the insert pin and member pin are configured to be engageable with a connector of the net holding portion so that the net holding portion can be supported by the insert pin at a first height and by the vertical member at a second height.

Yet additional embodiments additionally comprising a simulated baseball base having an aperture and being slidably positioned over the insert post.

In accordance with another embodiment, the present disclosure provides a method for performing sports drills on a ball field having a plurality of below-grade base anchors. The method comprises engaging an insert post of a training device with one of the plurality of below-grade base anchors. The training device comprises a frame having a support portion and a net holding portion, the net holding portion supporting a net, and the support portion comprising the insert post. The method further comprises moving the net holding portion relative to the support portion so that the net faces a desired training position on the ball field, and targeting the net with a ball from the desired training position.

In additional embodiments, moving the net holding portion comprises rotating the net holding portion relative to the support portion.

In yet additional embodiments, the support portion has a vertical axis, and the method additionally comprises moving the net holding portion in a direction transverse to the vertical axis.

In some such embodiments, moving the net holding portion in a direction transverse to the vertical axis comprises rotating the net holding portion about an axis transverse to the vertical axis.

In other such embodiments, moving the net holding portion in a direction transverse to the vertical axis comprises translating the net holding portion along an axis transverse to the vertical axis.

In still other such embodiments, the support portion has a support pin, and the method comprises arranging an offset member atop the support pin, the offset member having an offset pin spaced from and parallel to the support pin, and attaching the net holding portion onto the offset pin.

Further embodiments additionally comprise attaching a net extender to the net holding portion so that a holder of the net extender is spaced from the net holding portion, and supporting the net with the holder.

Yet further embodiments additionally comprise assembling a portable support, removing the insert post from the base anchor and inserting the insert post into a post receiver of the portable support.

Still further embodiments additionally comprise modifying a configuration of the support portion so as to change a height of the net holding portion.

In some such embodiments modifying the configuration of the support portion comprises adding or removing a vertical support member.

DESCRIPTION

Figure 1:
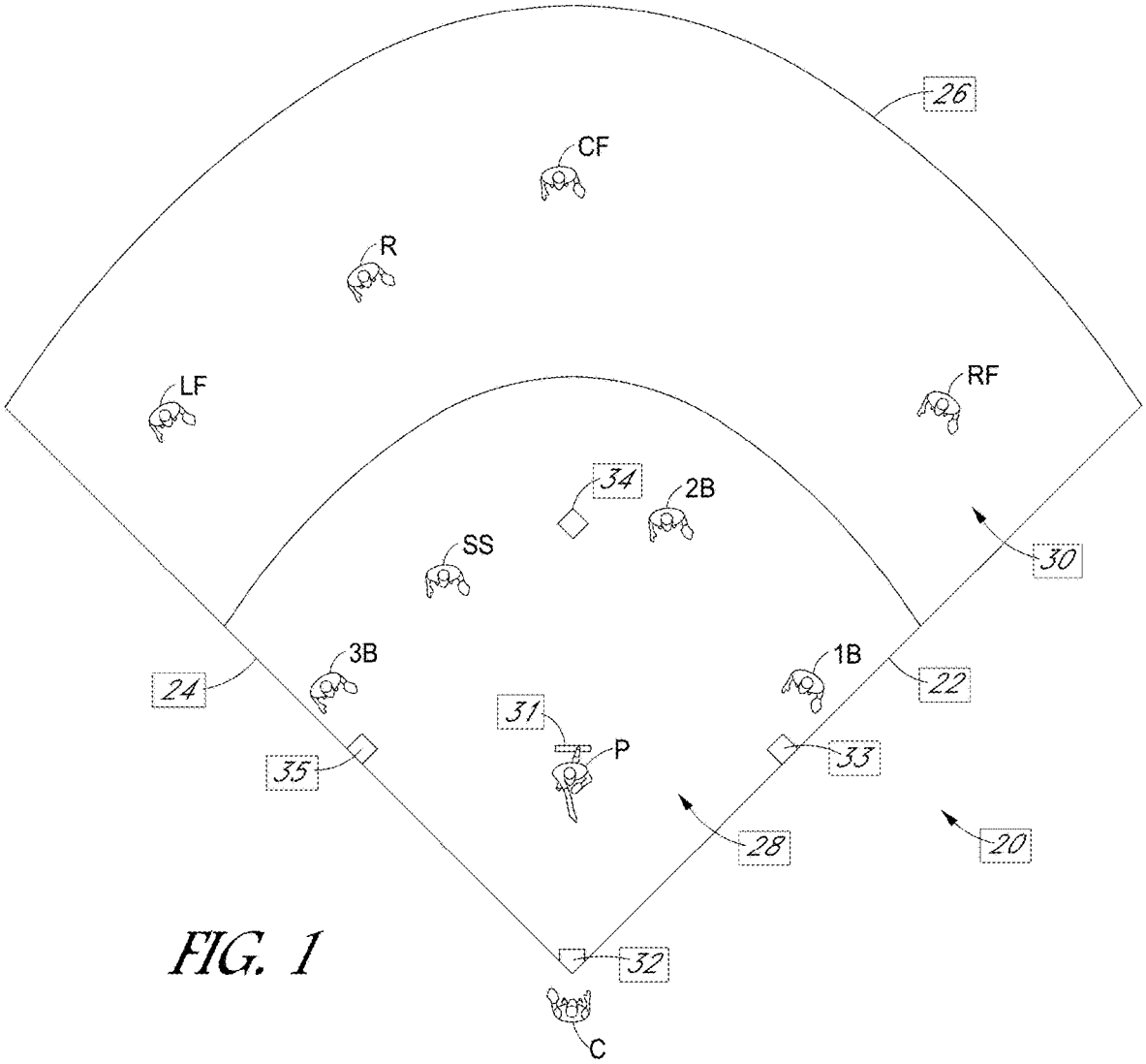
FIG. 1 is a schematic view of a ball field for use in baseball or softball.

The present specification describes a device and method for facilitating baseball and softball practice. With initial reference to FIG. 1, a schematic representation of a baseball/softball field 20, referred to as a ball field 20, is presented. As shown, the ball field 20 is delineated by a first foul line 22, or first base-side foul line, and a third foul line 24, or third base-side foul line, and an outfield fence 26. The ball field further includes an infield 28 portion and an outfield 30 portion. Further structure of a typical ball field 20 include a pitching rubber 31, home plate 32, first base 33, second base 34 and third base 35.

Typical player positions for the infield 28 include pitcher P, catcher C, first baseman 1B, second basemen 2B, third baseman 3B and shortstop SS. Typical player positions for the outfield 30 include right fielder RF, center fielder CF and left fielder LF. Softball typically also includes a rover R in the outfield 30. Each of these player positions has a unique role, and is expected to react in different ways to particular situations. For example, depending on the number and location of baserunners and the placement of a batted ball, and even on the number of outs or the score, each of the outfielders may be expected to make a throw to a different base, and even a different side of the base.

Figure 2:
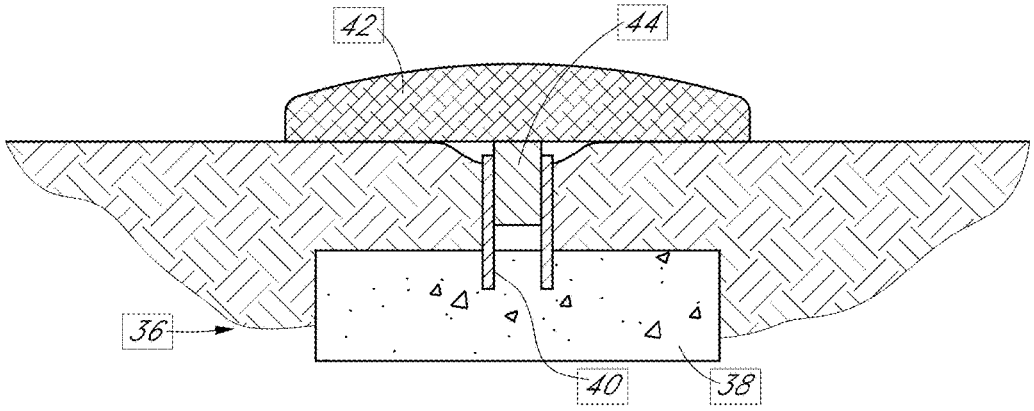
FIG. 2 is a side cross-sectional view of an example base and base anchor of a typical ball field.

With additional reference to FIG. 2, each of the bases in such ball fields 20 typically is removable. At each base position there is a base anchor assembly 36 that is positioned below grade 37. In the illustrated embodiment the base anchor assembly 36 comprises an underground concrete anchor 38 that supports an upwardly-directed anchor post 40. The anchor post 40 typically is a hollow, tubular member having a square cross-section. A typical base 42 includes an elongated base post 44 having a square cross-section complementary to that of the anchor post 40 so that it can removably fit securely within the anchor post 40 while the associated base 42 rest upon the ground 37. The base anchor assembly 36 typically is configured to withstand substantial lateral and torque forces so that when an athlete slides into the base at high speed the base will remain in a stable position, and will not substantially twist or break free.

Figure 3:
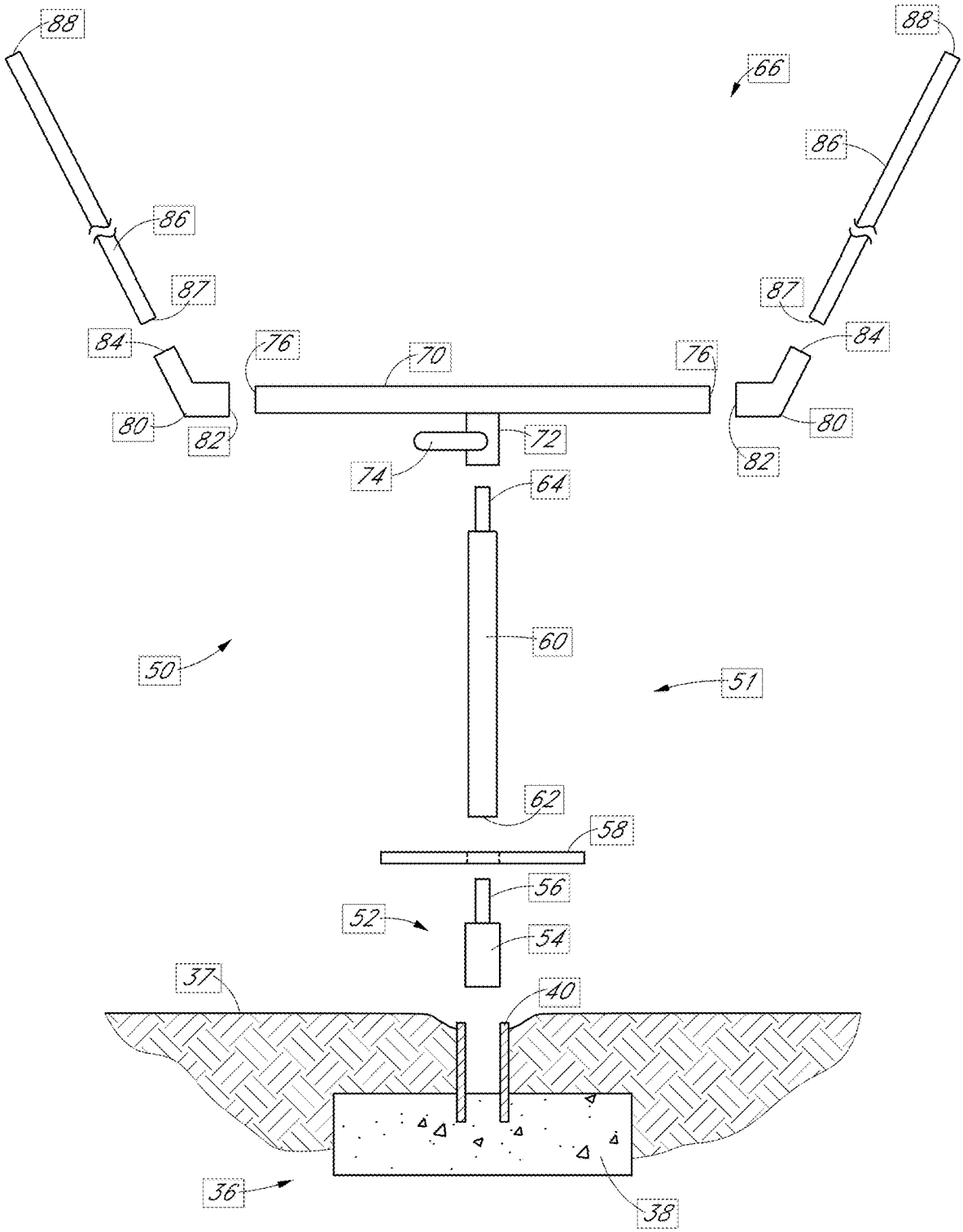
FIG. 3 is an exploded view of an embodiment of a frame of a training device having features as discussed herein.
Figure 4:
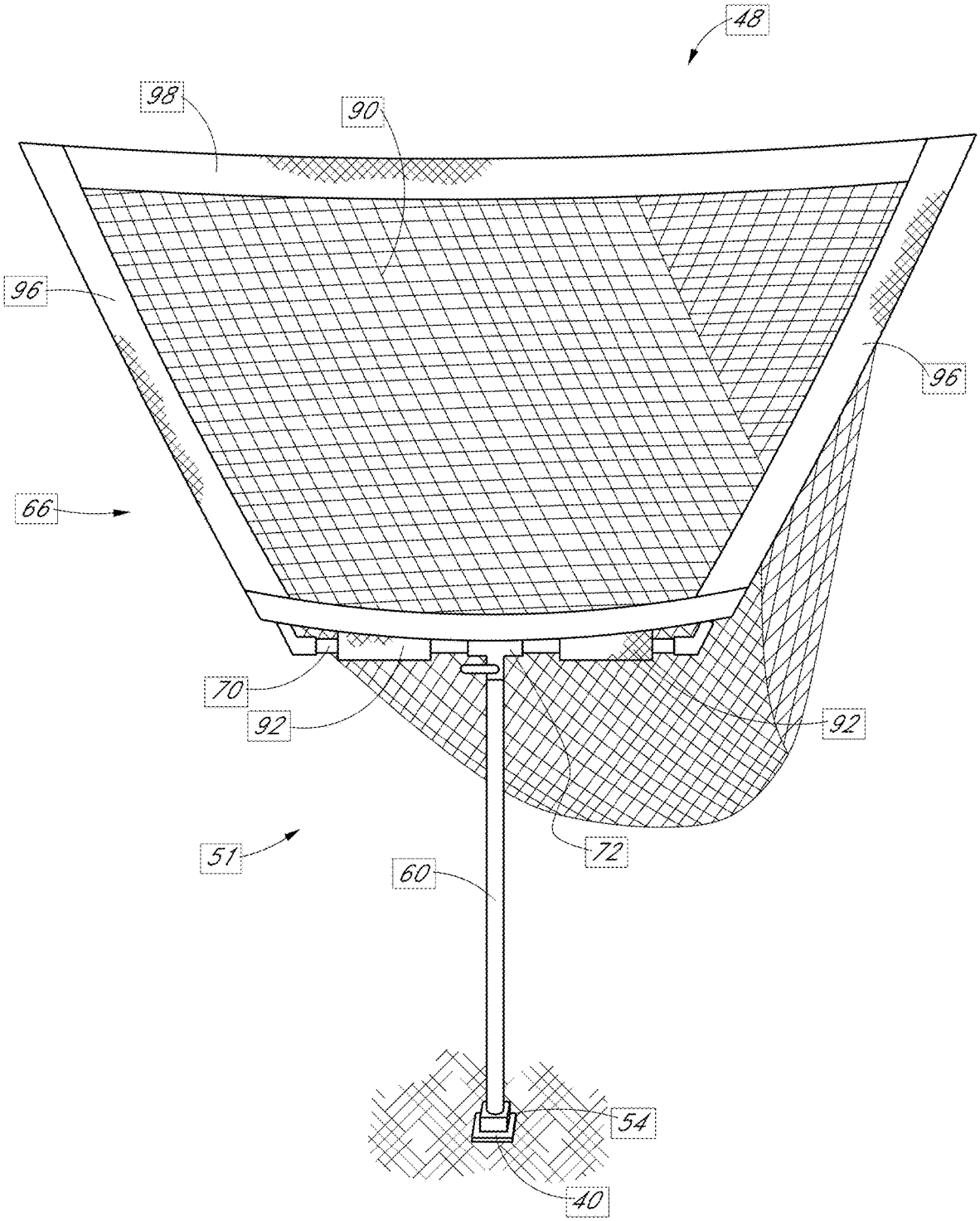
FIG. 4 shows a view of an embodiment of a training device.

With reference next to FIGS. 3 and 4, the present practice training device comprises a training net 48 comprising a frame 50 configured to support a mesh net 90.

With particular reference to FIG. 3, the frame 50 comprises a support portion 51 configured to support a net holding portion 66. The support portion 51 comprises an insert 52 made up of an insert post 54 and a pin 56. The insert post 54 preferably has a square cross-section configured to fit complementarily within the anchor post 40. In some embodiments, the insert post 54 is mildly wedge-shaped, becoming larger in cross-section moving upwardly from its bottom edge. As such, the insert post can be fit into the anchor post 40 and will eventually engage the internal surfaces of the anchor post 40, holding the insert 52 securely in place. The pin 56 extends upwardly from the insert post 54. As such, at least the insert post 54 portion of the insert 52 extends below grade 37 and into the anchor post 40, but the pin 56 extends upwardly above the surface 37. In some embodiments, a simulated baseball base 58 can be placed over the insert 52 so that it rests on the surface 37.

An elongated vertical member 60 has a bottom end 62 configured to fit complementarily over the pin 56 to be supported by the insert 52. A top end 64 of the vertical member 60 is sized and configured substantially the same as the pin 56. In a preferred embodiment, the pin 56 has a round cross-section, as does the vertical member 60.

As discussed above, the net holding portion 66 can be supported by the support portion 51. The net holding portion 66 comprises an elongated cross member 70 having a coupler 72 connected thereto, such as by welding. The coupler 72 is configured to fit complementarily over the top end 64 or, if it is desired to support the net holding portion 66 closer to the ground level 37, the pin 56. In this position, the coupler 72 is rotatable about whichever of the top end 64 or pin 56 upon which it is supported. A clamp 74 on the coupler 72 is configured to selectively engage the pin 56 or top end 64 when the user has rotated the coupler 72, and associated net holding portion 66, to a desired rotational position. Thus, the net holding portion 66 can be rotated about the support portion 51 to a desired rotational position, and then secured into place in that position.

The illustrated crossmember 70 comprises an elongated bar, such as a metal tube having a circular or non-circular cross section. The crossmember 70 terminates at opposite ends 76. A pair of connectors 80 each have a first end 82 and a second and 84. The first ends 82 are configured to fit complementarily over the opposite ends 76 of the cross-member 70 so as to fit securely thereon. End 76 and first end 82 can be keyed if desired so as to prevent the connectors 80 from rotating when connected to the crossmember 70.

As shown in FIG. 3, preferably the connectors 80 are configured so that their second ends 84 open in a direction directed across the direction of that in which the first ends 82 open. In the illustrated embodiment, the second end 84 opens a direction less than 90° relative to the direction in which the first end 82 opens. In other embodiments, the relative angle may be 90°, or any other angle as desired. A pair of elongated side posts 86 each have a base end 87 and a tip 88. The base end 87 fits into the second ends 84 of the connectors 80, such as in a bayonet style, to hold the side posts 86 in place. In the illustrated embodiment, the side posts 86 are flexible elongated rods such as fiberglass rods.

With additional reference to FIG. 4, the net holding portion 66 is configured to support a mesh net 90. The illustrated mesh net 90 comprises a pair of bottom sleeves 92 that are configured to slip over the frame crossmember 70 on opposite sides of the coupler 72. A pair of side sleeves 96 are configured to slide over corresponding side posts 86. Thus, the mesh net 90 is supported by the crossmember 70 and side posts 86 of the frame 50. A top edge 98 of the net 90 extends the between the side sleeves 96. In some embodiments, the length of the top edge 98 is somewhat less than an at-rest distance between the side post tips 88. As such, when the net 90 is installed on the frame 50, the side posts 86 are deflected and under tension, holding the top edge 98 of the net 90 tight.

Figure 5A:
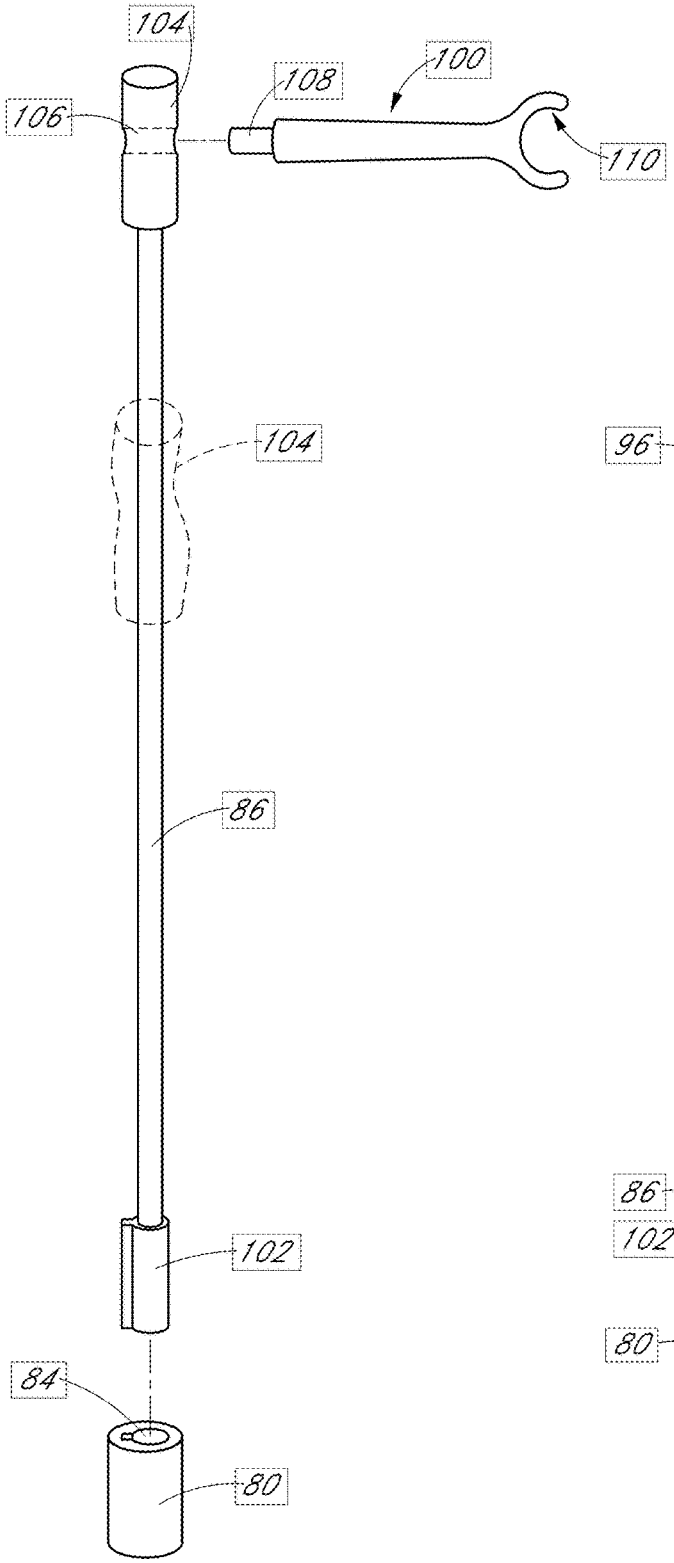
FIG. 5A shows an exploded view of an embodiment of a net extender associated with a side post.
Figure 5B:
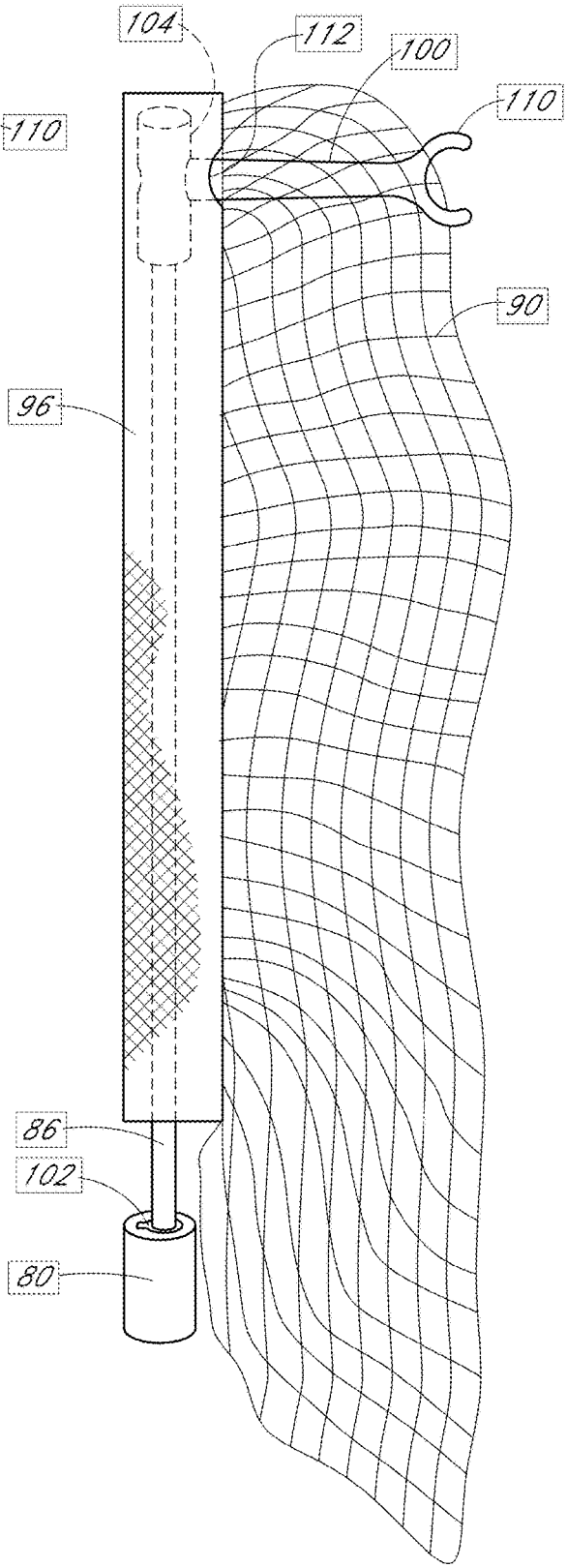
FIG. 5B shows the embodiment of FIG. 5A assembled.

In some situations, it can be desired to space the body of the mesh net 90 from the frame 50, and more specifically to space the mesh net 90 backwardly from the frame 50. In accordance with another embodiment, and with reference next to FIGS. 5 A and B, a net extender 100 is configured to selectively connect to another embodiment of each side post 86. The illustrated side post 86 comprises a keyed base 102 configured to fit complementarily within a keyed second end 84 of the connector 80. As such, the position of the side post 86 is established and the side post 86 will not rotate within the second end 84.

A mount 104 on the side post 86 preferably includes a receiving slot 106 configured to receive a pin 108 of the net extender 100. With the side post 86 in the correct position connected to the keyed connector 80, the receiving slot 106 is directed to open rearwardly so that when the net extender 110 pin 108 is received in the slot 106, the net extender 100 extends rearwardly from the rest of the frame 50. A net holder 110 of the net extender 100 is configured to engage and hold a portion of the mesh net 90. In the illustrated embodiment the mount 104 is disposed at the tip of the side post 86. In another embodiment, and as shown in ghost lines, the mount 104 can be spaced a distance from the tip.

Preferably, a sleeve hole 112 is formed through the net side sleeve 96 and is sized, configured and positioned to generally align with the receiving slot 106 when the side post 86 is disposed within the sleeve 96. A user can thus, after placing the mesh net 90 over the side post 86, advance the net extender 100 through the net 90 and slide the pin 108 into the receiving slot 106. A portion of the mesh net 90 can then be pulled over the holder 110, thus spacing the net 90 from the posts 86. The net 90 thus hangs downwardly from the holder 110, and is spaced from the frame 50.

Figure 6:
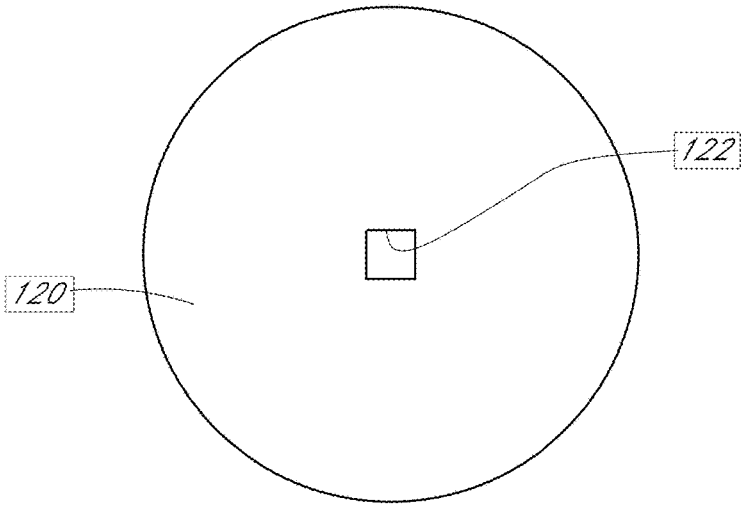
FIG. 6 is a top view of an embodiment of a weighted base.

With reference next to FIG. 6, in another embodiment, a weighted base 120 can include a receiver 122 configured to receive the insert post 54. The illustrated weighted base 120 comprises a circular member made of a heavy material such as concrete or the like, or adapted to be filled with water or sand. The weighted base 120 is configured to hold up the training net 48. The weighted base 120 is thus able to support the training net 48 without requiring a base anchor assembly 36. As such the training net 48 can be used at locations spaced from anchor assemblies 36 or on fields without such anchor assemblies. However, due to its weight, the weighted base 120 is difficult to transport.

Figure 7:
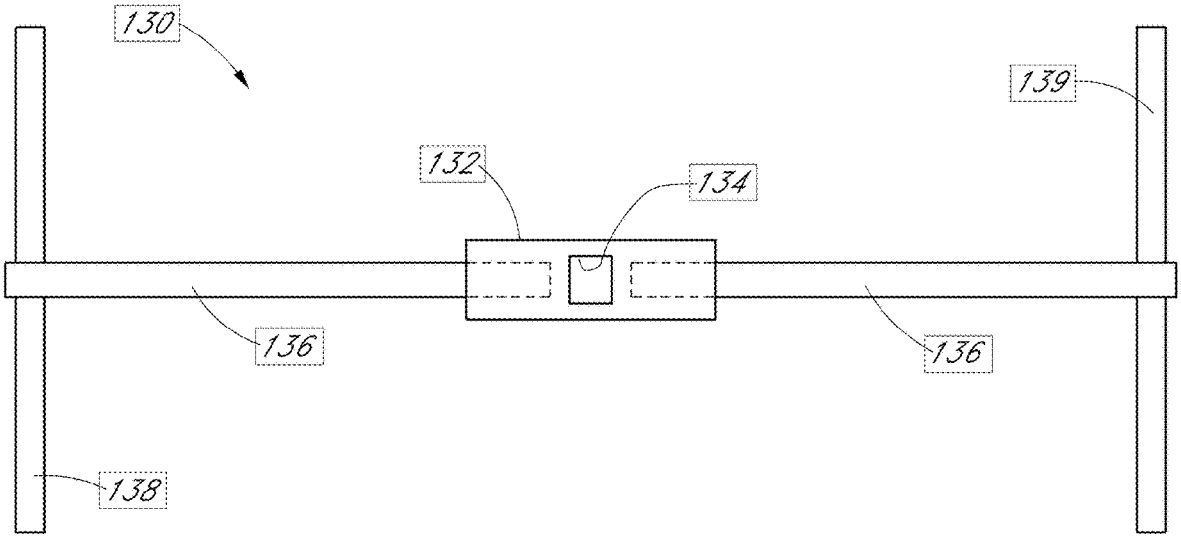
FIG. 7 is a top schematic view of an embodiment of a portable support.
Figure 8:
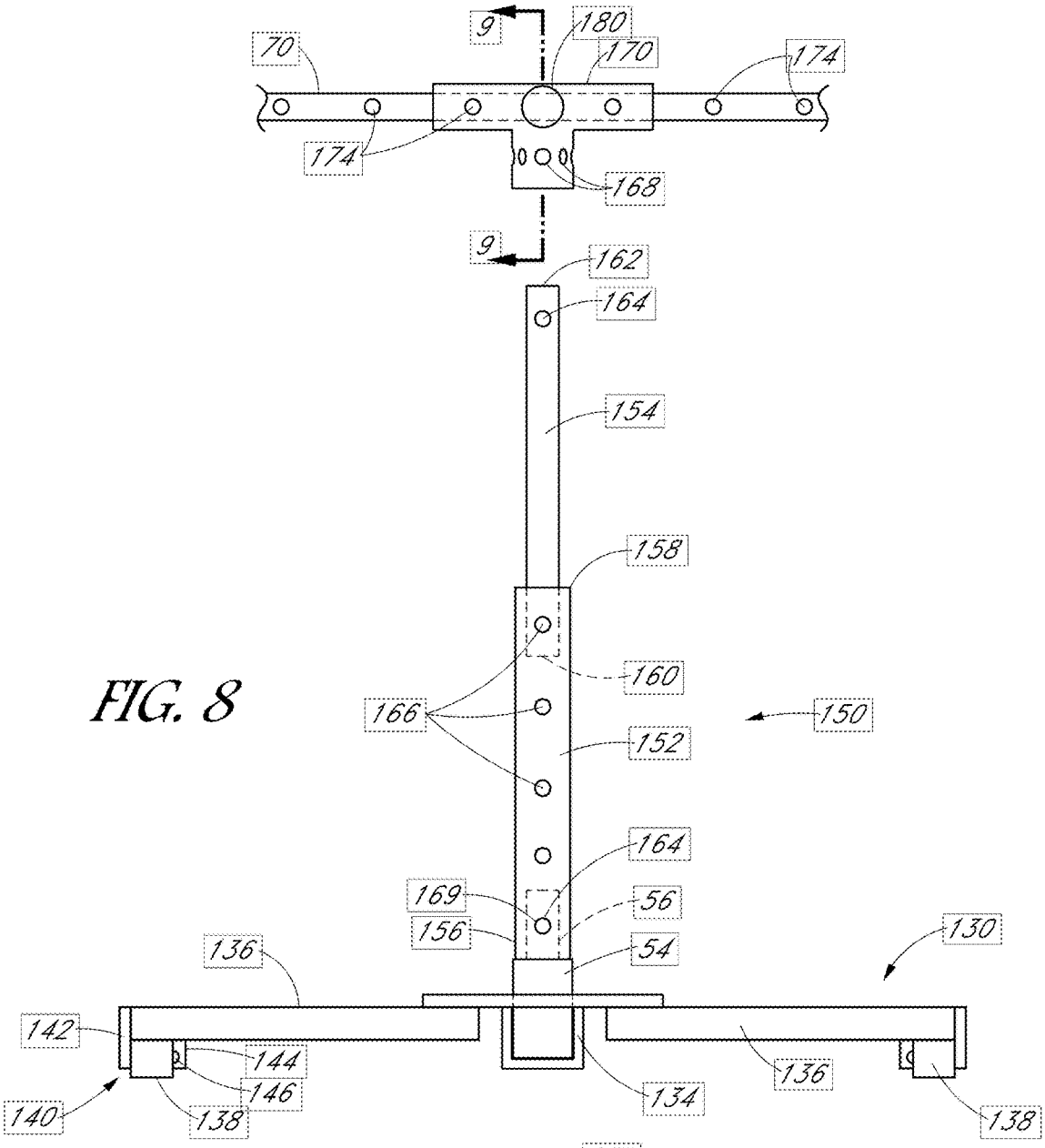
FIG. 8 shows a side view of another embodiment of a frame.

With reference next to FIGS. 7 and 8, in another embodiment, a portable support 130 is also configured to support the frame 50 and net 90 in independent of an anchor assembly 36, but is light enough to be portable. In the illustrated embodiment, the portable support 130 comprises a flat plate 132 having a receiver 134 formed therein. The receiver 134 is configured to complementarily receive the insert post 54. A pair of elongated bars 136 are attached to the plate 132 on opposite sides of the receiver 134 and extend outwardly. A leg 138 is releasably attachable to a leg receiver 140 at the end of each elongated bar 136. Each leg receiver 140 comprises a spaced apart first member 142 and second member 144. A detent mechanism 146, such as a spring-loaded pin, is configured to releasably hold the leg 138 in place.

Figure 9:
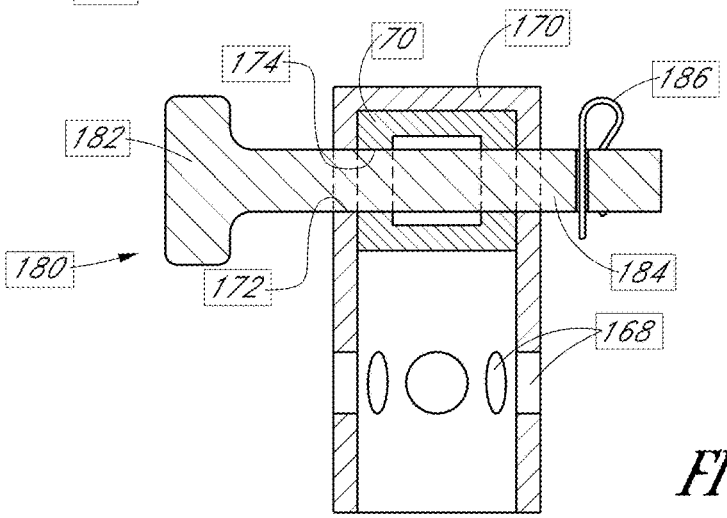
FIG. 9 is a cross-sectional view taken along lines 9-9.

With particular reference to FIGS. 8 and 9, another embodiment of a frame 50 comprises a telescoping vertical member 150 made up of a bottom member 152 and a top member 154. The top member 154 is configured to slidably move within the bottom member 152. A bottom end 156 of the bottom member 152 fits complementarily over the pin 56. A top end 158 of the bottom member 152 receives a bottom end 160 of the top member 154 therewithin. A top end 162 of the top member 154 is sized and configured similarly to the pin 56. In the illustrated embodiment, spring-loaded pins 164 are provided adjacent both the top end 162 and the bottom end 160. The bottom member 152 has a plurality of spaced apart discrete holes 166 configured to accommodate the spring-loaded pin 164. As such, the top member 154 slides within the bottom member 152, but is releasably held at any one of the discrete holes 166. Thus, the user can set the length of the telescoping vertical member 150 at a desired height by selectively engaging the spring-loaded pin 164 with one of the holes 166. The illustrated pin 56 preferably also includes a spring-loaded pin 164 to help secure the bottom member 152 in place.

In the illustrated embodiment, the crossmember 70 is held within a sliding coupler 170. The coupler 170 is also configured to fit over and engage the top end 162 (or, if desired, the pin 56). Several discrete holes 168 are disposed angularly spaced from one another about the circumference of the coupler 170. Thus, a user can, by selective engagement of the spring-loaded pin 164 with one of the discrete holes 168, set the frame up at any one of a plurality of discrete rotational positions relative to the vertical member 150. Preferably, one or more holes 169 are also disposed adjacent the bottom end 156 of the bottom member 152 so that a spring-loaded pin 164 on the pin 56 can releasably engaged the bottom member 152.

The coupler 170 receives the crossmember 70 slidably therein. The illustrated coupler 170 includes a pair of aligned front and back holes 172. Several sets of aligned front and back holes 174 are formed in the crossmember 70. When holes 174 are aligned with holes 172, a removable stop member 180 can be advanced through the aligned holes 172, 174 to block the crossmember 70 from sliding relative to the coupler 170. In this manner, the crossmember 70 can be moved side to side and locked into one of a plurality of spaced apart positions as desired.

The illustrated removable stop member 180 comprises a handle 182 which supports an elongated shaft 184. When the shaft extends through the crossmember 70 and coupler 170, a cotter pin 186 can be advanced through a hole in the shaft 184 to block the stop member 180 from being unintentionally removed. In this manner, the crossmember can be moved left to right relative to the coupler 170 and securely held in place, so that the position of the net holding portion 66 can be moved relative to the vertical member 150. This increases the versatility and customization of the device, particularly when the device is being used with an underground anchor post 40.

Figure 10:
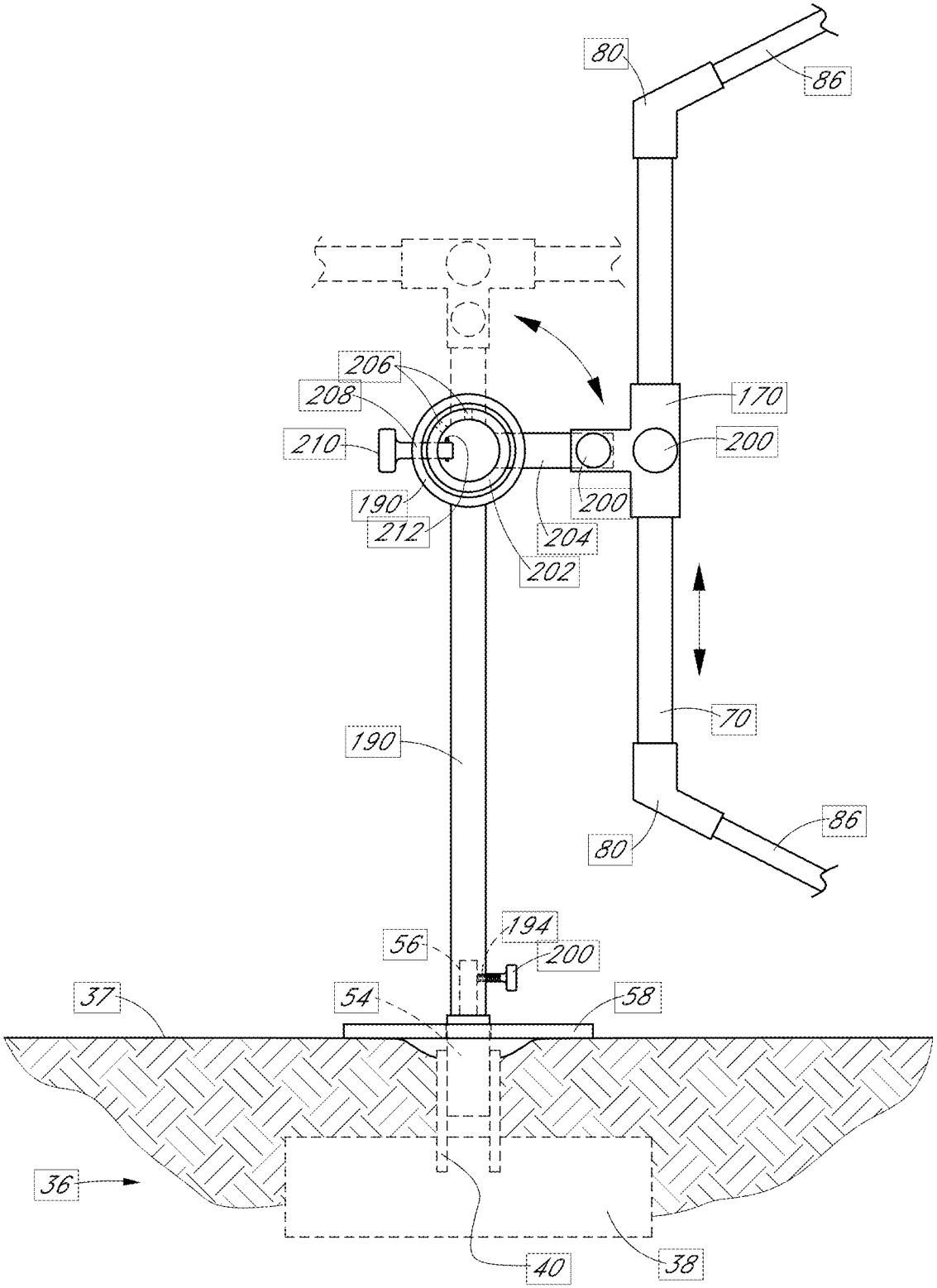
FIG. 10 shows a side view of yet another embodiment of a frame.

With reference next to FIG. 10, in another embodiment the net holding portion 66 can be rotated relative to the a vertical member 190. In this embodiment, the vertical member 190 includes a housing 192 at its top end. As in other embodiments, the bottom end fits over the pin 56. A threaded hole 194 is formed through a side of the vertical member 90 and a threaded stop member 200 can be threaded through the threaded hole 194 and into contact with the pin 56. When tightened, the stop member 200 will apply sufficient friction to stop the vertical member 190 from rotating relative to the pin 56. In use, the vertical member 190 can be rotated until it is in a desired position, and the stop member 200 advanced to hold it in the selected position. As such, the rotatable position of the vertical member 190 relative to the pin 56 is infinitely adjustable. It is to be understood that the similar infinitely-adjustable configuration employing a stop member 200 can be employed in other embodiments and in connection with other features such as in connection with the crossmember 70 that is slidable relative to the coupler 170, a telescoping vertical member, or the like.

In the illustrated embodiment, an inner support 202 is received within the housing 192 so that it can rotate within the housing 192. A top member 204 extends from the inner support 202 and is sized similar to the pin 56 so as to fit within a coupler 170. In the illustrated embodiment, a threaded stop member 200 can be employed to secure the coupler 170 onto the top member 204 at any desired rotational angle.

A plurality of spaced apart inner apertures 206 are formed through the inner support 202. The housing 192 includes a housing aperture 208. The inner support 202 can rotate within the housing 192 so that any one of the angularly spaced apart inner apertures 206 can be aligned with the housing aperture 208. A removable stop member 210 can fit through aligned housing apertures 208 and inner apertures 206 to lock the top member 204 at an angle relative to the vertical member 190. In the illustrated embodiment, the top member 204 can be secured in one of a plurality of discrete positions between 0°, and which it is aligned with an axis of the vertical member 190, and 90°, at which it is perpendicular to the vertical member 190. A slot (not shown) in the housing 192 accommodates movement of the top member 204 through this range of rotation. In the illustrated embodiment, a spring-loaded ball detent 212 is disposed on the end of the removable stop member 210 to prevent inadvertent removal of the stop member 210, but allow such removal when the user pulls on the stop member 210.

In the embodiment illustrated in FIG. 10, the crossmember 70 is slidable within a coupler 170, but instead of being selectively held at a plurality of discrete, spaced apart locations, it is selectively held in place via a threaded stop member 200, and thus is infinitely adjustable from side to side relative to the coupler 170.

Figure 11:
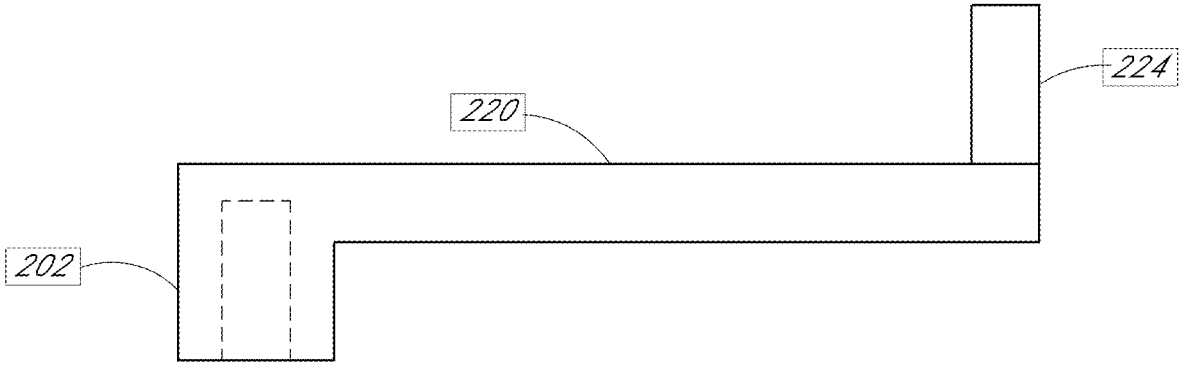
FIG. 11 shows a side view of an embodiment of an offset member for use with frame embodiments.

With reference next to FIG. 11, in another embodiment, an offset member 220 comprises a receiver end 222 configured to receive the pin 56 or a top end of a vertical member. The offset member 220 extends in a transverse direction from the receiver end 220 and terminates in a pin end 224. The pin end 224 preferably extends vertically upwardly, and preferably is configured to be received by a coupler. In this manner, the user may choose to select an offset member 220 in order to offset the net 90 relative to the base anchor post 40 and insert 52.

Training nets 48 incorporating features as discussed above can be used effectively to practice many positions and situational plays. The device 48 can be installed on a base anchor and then set up, via rotation and/or offsetting of the net holding portion 68 relative to the support portion 51, to be an ideal target for a particular practice drill.

For example, in a situation in which a batter hits a single to the outfield with no runners on base, the correct play for each of the outfielders typically is to throw the ball in to second base. The training net 48 can be placed in the second base anchor, and rotated to face the outfield. Since it is desired for the throw to be caught by a standing player, the device is set up so that the net holding portion is at its high position. If only a single position is performing the drill, the device 48 will be rotated to face the particular position performing the drill. For example, if only right field is being drilled, the net holding portion will be rotated to face right field. If more than one position is performing the drill, the net holding portion may be rotated to face between the positions. This drill could be modified to simulate a batter/runner trying to run to second base. In such an event, the runner may be expected to slide into second base, and thus an ideal through will be low in order to facilitate a quick tag of the runner. Thus, for such a drill a user can modify the device to place the net 90 in a low position, such as by removing the vertical member. In other embodiments the net can be lowered by telescoping the vertical member downwardly or, in embodiments so equipped, by rotating the net holding portion downwardly toward the ground.

In another drill, the third base position may make a throw to first base. The training device 48 can be mounted at the first base position, and the net holding portion rotated to face the third base position. Preferably, the net holding portion is set up at a high position. In some embodiments, an offset 220 can be employed to offset the net holding portion 66 toward the third base position. This may simulate a game situation, in which the first baseman is often reaching, or "stretching", toward the third base position to receive the throw. Similar principles can be employed to setup the training device 48 for other infield positions, such as second base and shortstop. Notably, used of the simulated base 58 maintains the visual of the base for the player performing the drill.

Another drill can simulate a throw to first base due to a bunted ball, which typically travels only a short distance and is adjacent one of the foul lines 22, 24. In such a drill, the device is again set up at the first base position and rotated to face the throw. Some embodiments may account for the fact that a runner will be running toward first base 33, and may be near to the line of a throw to first base. As such, the offset 220 can be employed and/or the cross member 70 may be slid relative to the associated coupler to move the net holding portion 66 away from the foul line 22, and thus training the drilling players to target the first baseman to the inside of first base 33.

Another drill can help the catcher position practice a throw to second base 34, such as to throw out a runner attempting to steal the base. As expected, the training device 48 can be set up at the second base anchor, with the net holding portion 66 facing the catcher position. During a steal, the runner must be tagged out, and such runners are typically sliding into the base. Thus, the best throw from the catcher is fairly low in order to facilitate a quick tag. As such, preferably the net holding portion is placed in a low position, such as by adjusting a telescoping vertical member or dispensing with the vertical member altogether so that the net is positioned to provide a low target. In some embodiments it may be desired for the catcher to throw the ball both low and to the first-base side of second base 34. As such, the user may adjust the cross member 70 relative to the associated coupler to bias the net holding portion 66 to the first-base side of second base. In another embodiment a setup as in FIG. 10 may be used to rotate the net holding portion 66 to be positioned both low and offset to the first-base side of second base. The offset 220 can also be employed for such a drill.

Another game situation is when, due to runner positions, an outfielder is expected to throw the ball to a "cutoff man", who will not be positioned at one of the bases. In such a situation the training device 48 will not be installed on one of the base anchors, and preferably will not employ the simulated base 58. Instead, the portable support 130 can be assembled and placed at a typical cutoff position, such as shallow left field. The training device 48 can be installed on the portable support 130, and fielders may practice throwing the ball to a cutoff man.

The training device 48 installed on the portable support 130 can also be employed for other drills in which the device cannot be installed on a base anchor. For example, in order to practice throwing out a runner sliding into home plate H, the device can be setup with the net in a low position and the device positioned to provide a target on the third-base side of home plate.

The embodiments discussed above have disclosed structures with substantial specificity. This has provided a good context for disclosing and discussing inventive subject matter. However, it is to be understood that other embodiments may employ different specific structural shapes and interactions. For example, different structures can be employed for any of the various laterally or rotatably adjustable features.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. For example, one mode can have a vertical member employing features of both the vertical member 190 depicted in FIG. 10 and the telescoping vertical member 150 depicted in FIG. 8. In fact, it is contemplated that additional embodiments can mix and match various features discussed herein. Thus, it is intended that the scope of the inventive subject matter herein disclosed should not be limited by the particular disclosed embodiments described above, but should be determined only by a fair reading of the claims that follow.

What is claimed is:

1. A sports training system, comprising:

a ball field having a below-grade base anchor, the below-grade base anchor having a square opening;

a sports training device, the device comprising:

a frame comprising a support portion and a net holding portion, the net holding portion being attachable to and supported by the support portion and configured to hold a net so that the net has a front side and a back side, the net holding portion being rotatable relative to the support portion about a vertical axis in a first rotated position and a second rotated position, the net holding portion being sufficiently large to mimic a player catching a ball being thrown;

a detent attached to the net holding portion, when the detent is in an engaged position, the detent locks the net holding portion in either one of the first or second rotated positions relative to the support portion and when the detent is in a disengaged position, the detent allows free movement of the net holding portion between the first and second rotated position; and the support portion comprising an insert post having a square outer surface, the square insert post removably inserted into the below-grade base anchor of the ball field so that the frame is supported by the below-grade base anchor;

wherein a position of the net holding portion is rotatably adjustable at the first or second rotated position relative to the support portion so that the front of the net can be put in a desired rotational position while the insert post remains in the same rotational position before and after net holding portion is rotationally adjusted to the first or second rotated positions.

2. The system of claim 1, additionally comprising an extender configured to be releasably attachable to the net holding portion so as to extend backwardly from the net holding portion and configured to hold a portion of the net spaced from a front side of the net.

3. The system device of claim 1, wherein the net holding portion is configured to be movable relative to the support portion in a direction transverse to the vertical axis, and a securement device is configured to lock the net holding portion to the support portion with the net holding portion offset relative to the vertical axis.

4. The system of claim 1, wherein the support portion comprises an elongated vertical member that is releasably attached to an insert pin of the insert post.

5. The system of claim 4, wherein the vertical member has a member pin, each of the insert pin and member pin configured to be engageable with a connector of the net holding portion so that the net holding portion can be supported by the insert pin at a first height and by the vertical member at a second height.

6. The system of claim 1 additionally comprising a simulated baseball base having an aperture and being slidably positioned over the insert post.

7. A method for performing sports drills on a ball field, the method comprising:

Providing a ball field having a below-grade base anchor, the below-grade base anchor having a square opening:

Providing a sports training device, the device comprising:

a frame comprising a support portion and a net holding portion, the net holding portion being attachable to and supported by the support portion and configured to hold a net so that the net has a front side and a back side, the net holding portion being rotatable relative to the support portion about a vertical axis in a first rotated position and a second rotated position, the net holding portion being sufficiently large to mimic a player catching a ball being thrown:

a detent attached to the net holding portion, when the detent is in an engaged position, the detent locks the net holding portion in either one of the first or second rotated positions relative to the support portion and when the detent is in a disengaged position, the detent allows free movement of the net holding portion between the first and second rotated position: and the support portion comprising an insert post having a square outer surface, the square insert post removably inserted into the below-grade base anchor of the ball field so that the frame is supported by the below-grade base anchor;

wherein a position of the net holding portion is rotatably adjustable at the first or second rotated position relative to the support portion so that the front of the net can be put in a desired rotational position while the insert post remains in the same rotational position before and after net holding portion is rotationally adjusted to the first or second rotated positions, engaging the insert post of the training device with one of the plurality of below-grade base anchors;

moving the net holding portion relative to the support portion so that the net faces a desired training position on the ball field; and targeting the net with a ball from the desired training position.

8. The method as in claim 7, wherein moving the net holding portion comprises rotating the net holding portion relative to the support portion.

9. The method as in claim 7, wherein the support portion has a vertical axis, and additionally comprising moving the net holding portion in a direction transverse to the vertical axis.

10. The method as in claim 9, wherein moving the net holding portion in the direction transverse to the vertical axis comprises rotating the net holding portion about an axis transverse to the vertical axis.

11. The method as in claim 9, wherein moving the net holding portion in the direction transverse to the vertical axis comprises translating the net holding portion along an axis transverse to the vertical axis.

12. The method as in claim 9, wherein the support portion has a support pin, and comprising arranging an offset member atop the support pin, the offset member having an offset pin spaced from and parallel to the support pin, and attaching the net holding portion onto the offset pin.

13. The method as in claim 7, additionally comprising attaching a net extender to the net holding portion so that a holder of the net extender is spaced from the net holding portion, and supporting the net with the holder.

14. The method as in claim 7, additionally comprising assembling a portable support, removing the insert post from the base anchor and inserting the insert post into a post receiver of the portable support.

15. The method as in claim 7, additionally comprising modifying a configuration of the support portion so as to change a height of the net holding portion.

16. The method as in claim 15, wherein modifying the configuration of the support portion comprises adding or removing a vertical support member.

* * * * *